US009476660B2

(12) United States Patent
Potter et al.

(10) Patent No.: US 9,476,660 B2
(45) Date of Patent: Oct. 25, 2016

(54) FIREARM SAFETY MECHANISM

(71) Applicant: Sturm, Ruger & Company, Inc., Southport, CT (US)

(72) Inventors: Dwight Potter, Unity, NH (US); Jason Pittman, Andover, NH (US); Scott Warburton, South Acworth, NH (US)

(73) Assignee: STURM, RUGER & COMPANY, INC.

( * ) Notice: Subject to any disclaimer, the term of this patent is extended or adjusted under 35 U.S.C. 154(b) by 0 days.

(21) Appl. No.: 14/750,020

(22) Filed: Jun. 25, 2015

(65) Prior Publication Data

US 2015/0377575 A1 Dec. 31, 2015

Related U.S. Application Data

(60) Provisional application No. 62/017,363, filed on Jun. 26, 2014.

(51) Int. Cl.

| | |
|---|---|
| ***F41A 11/00*** | (2006.01) |
| ***F41A 17/62*** | (2006.01) |
| ***F41A 17/52*** | (2006.01) |

(52) U.S. Cl.

CPC ..... *F41A 11/00* (2013.01); *F41A 17/52* (2013.01); *F41A 17/62* (2013.01)

(58) Field of Classification Search

CPC ..... F41A 17/52; F41A 17/62

See application file for complete search history.

(56) References Cited

U.S. PATENT DOCUMENTS

| | | | | |
|---|---|---|---|---|
| 1,141,256 A | | 6/1915 | Nelson | |
| 1,362,478 A | * | 12/1920 | Deitrich | F41A 17/52 42/43 |
| 1,583,617 A | * | 5/1926 | Smith | F41A 17/52 42/41 |
| 1,624,876 A | * | 4/1927 | Smith | F41A 17/52 42/1.04 |
| 1,930,864 A | * | 10/1933 | Schmeisser | F41A 17/52 42/1.01 |

(Continued)

OTHER PUBLICATIONS

Corresponding International Search Report and Written Opinion for PCT/US2015/037619 dated Sep. 15, 2015.

*Primary Examiner* — Troy Chambers
*Assistant Examiner* — Joshua Semick
(74) *Attorney, Agent, or Firm* — The Belles Group, P.C.

(57) ABSTRACT

A firearm with safety mechanism in one embodiment comprises a receiver, a trigger-actuated firing mechanism with movable trigger operable to discharge the firearm, and a safety mechanism configured to arrest the firing mechanism. The safety mechanism is movable between a first position preventing movement of the trigger and a second position allowing movement of the trigger for discharging the firearm. In one embodiment, an elongated stock bolt attaches a buttstock to the receiver. The stock bolt passes through a portion of the safety mechanism to engage the receiver. This allows an operating button of the safety to be ergonomically mounted on a top surface of the firearm above the stock bolt. In one implementation, the firing and safety mechanisms may each be operably mounted in a fire control module disposed in the receiver and removable therefrom as a separate self-supported unit.

21 Claims, 14 Drawing Sheets

(56) References Cited

U.S. PATENT DOCUMENTS

| | | | | | |
|---|---|---|---|---|---|
| 2,122,415 | A * | 7/1938 | Fraser | F41A 17/20 | 42/70.06 |
| 2,125,933 | A * | 8/1938 | Lewis | F41A 17/52 | 42/70.05 |
| 2,455,990 | A * | 12/1948 | Gaugler | F41A 17/52 | 42/70.06 |
| 2,465,699 | A * | 3/1949 | Smith | F41A 17/52 | 42/70.06 |
| 2,478,892 | A * | 8/1949 | Bistoff | F41A 17/52 | 42/70.06 |
| 2,821,040 | A * | 1/1958 | Tatman | F41A 17/52 | 42/41 |
| 2,867,930 | A * | 1/1959 | Niesp | F41A 17/52 | 42/41 |
| 2,914,877 | A * | 12/1959 | Willenbacher | F41A 17/52 | 42/70.06 |
| 2,926,445 | A | 3/1960 | Green et al. | | |
| 3,006,096 | A * | 10/1961 | Green | F41A 17/52 | 42/70.01 |
| 3,234,679 | A * | 2/1966 | Benson | F41A 3/24 | 42/16 |
| 3,257,749 | A * | 6/1966 | Donaldson | F41A 3/42 | 42/16 |
| 3,270,456 | A * | 9/1966 | Benson | F41A 3/24 | 42/16 |
| 4,811,511 | A * | 3/1989 | Beretta | F41A 19/15 | 42/42.01 |
| 4,964,232 | A | 10/1990 | Mainland et al. | | |
| 5,787,629 | A | 8/1998 | Campbell et al. | | |
| 6,907,687 | B2 * | 6/2005 | Rousseau | F41A 3/58 | 42/75.02 |
| 8,327,568 | B1 * | 12/2012 | Lavergne | F41A 9/70 | 42/71.01 |
| 2006/0207147 | A1 * | 9/2006 | Lazor | F41A 17/48 | 42/41 |
| 2013/0174459 | A1 | 7/2013 | Moretti | | |

* cited by examiner

FIREARM SAFETY MECHANISM

CROSS-REFERENCE TO RELATED APPLICATIONS

The present application claims the benefit of priority to U.S. Provisional Application No. 62/017,363 filed Jun. 26, 2014, the entirety of which is incorporated herein by reference.

BACKGROUND

The present invention generally relates to firearms, and more particularly to safety mechanisms for a firearm.

Various safety mechanisms have been used that function to selectively disable the fire control system for firearms. In long guns such as rifles and shotguns that employ a commonly used stock bolt for attaching the buttstock to the receiver, the safety operating switch or button must generally be mounted integrally in the receiver forward of the stock bolt (such as on the top) to avoid interference between the bolt and safety. This forward positioning of the safety button is not always the most convenient and user friendly location. In addition, the practice of separating the parts that comprise the safety assembly from those that comprise the fire control group (e.g. trigger, hammer, sear, etc.) sometimes followed unfortunately increases the tolerance stack-up ("tolerance stack") because these parts of each system must functionally interact. Tolerance stack is the cumulative sum or accumulation of individual component manufacturing and/or drawings tolerances in part assemblies having multiple interacting components. This can result in failure of parts to assemble properly, interference between various moving parts resulting in unsmooth operation or binding, and sometimes complete failure of mechanisms to function altogether. Accordingly, this may translate into increased manufacturing costs for re-machining and reliability issues.

An improved safety mechanism for a firearm is desired.

SUMMARY

A safety mechanism for a firearm is provided that minimizes the tolerance stack problem and further provides a user friendly mounting location for the safety operating button. In non-limiting embodiments, the safety mechanism and firing mechanism are mounted together in and a functional part of the fire control module. Advantageously, mounting both mechanisms in a single module results in the tolerance stack up being less and permits the parts to go together without custom fitting and re-machining. Another advantage is that this allows the entire fire control module including the safety to be assembled and tested outside of the firearm. Any potential fit or operating problems can be corrected more readily with greater access than dismounting the individual components from the firearm and reinstalling them to test again. This approach also allows any defective fire control modules to be separately addressed on the side and not impede the manufacturing production line and finished product output rate.

Furthermore, integration of the safety mechanism and firing mechanism in the fire control module allows for mounting the operating button of the safety mechanism in a more ergonomic and user friendly rearward location than in prior firearms. In one embodiment, the operating button may be mounted on top of a rear extension of the fire control module placing the button generally rearward of the receiver. The safety button may a slidable button in operation and configuration.

In certain embodiments, the present safety and fire control mechanisms are configured and arranged to allow the buttstock to be attached to the receiver using a stock bolt while providing the convenience of a more rearward and user friendly mounting location for the safety operating button. This provides a robust attachment for the buttstock while maintaining a desirable mounting location of the safety operating button. In one embodiment, the front end of the stock bolt connected to the receiver terminates at a point forward of the safety operating button which is mounted on a top surface of the firearm.

According to an aspect of the invention, a firearm with safety mechanism includes: a receiver arranged along a longitudinal axis; a trigger-actuated firing mechanism disposed in the receiver and comprising a movable trigger operable to discharge the firearm; a safety mechanism configured to arrest the firing mechanism, the safety mechanism movable between a first position preventing movement of the trigger and a second position allowing movement of the trigger for discharging the firearm; and an elongated stock bolt attaching a buttstock to the receiver, the stock bolt passing through a portion of the safety mechanism to engage the receiver. In one embodiment, a forward portion of the stock bolt extends through a longitudinal passageway formed in the safety mechanism.

According to an aspect of the invention, a firearm with safety mechanism includes: a receiver arranged along a longitudinal axis; a barrel coupled to a front end of the receiver;

a bolt axially movable forward and rearward in the receiver; a fire control module attached to the receiver and removable therefrom as a separate self-supported unit, the fire control module comprising a trigger-actuated firing mechanism having a movable trigger and a safety mechanism; the safety mechanism comprising a slideably movable operating button mechanically coupled to a blocking member, the blocking member linearly movable via operation of the operating button between a safe position engaged with the firing mechanism to prevent discharging the firearm and a ready-to-fire position disengaged from the firing mechanism to allow discharging the firearm; and an elongated stock bolt attaching a buttstock to a rear end of the receiver.

A method for assembling a firearm with safety mechanism includes: providing a trigger mechanism and a safety mechanism both pre-mounted in a self-supported fire control module, the safety mechanism including an operating button, an elongated blocking member movable to engage the trigger mechanism, and an elongated lever arm coupling the operating button to the blocking member; inserting the fire control module into a receiver of a firearm; positioning a buttstock against a rear end of the receiver; inserting an elongated stock bolt through the buttstock and an opening in the lever arm; and securing a front end of the stock bolt to a rear end of the receiver.

Further areas of applicability of the present invention will become apparent from the detailed description provided hereinafter.

BRIEF DESCRIPTION OF THE DRAWINGS

The features of the exemplary embodiments will be described with reference to the following drawings where like elements are labeled similarly, and in which.

Figure 1:
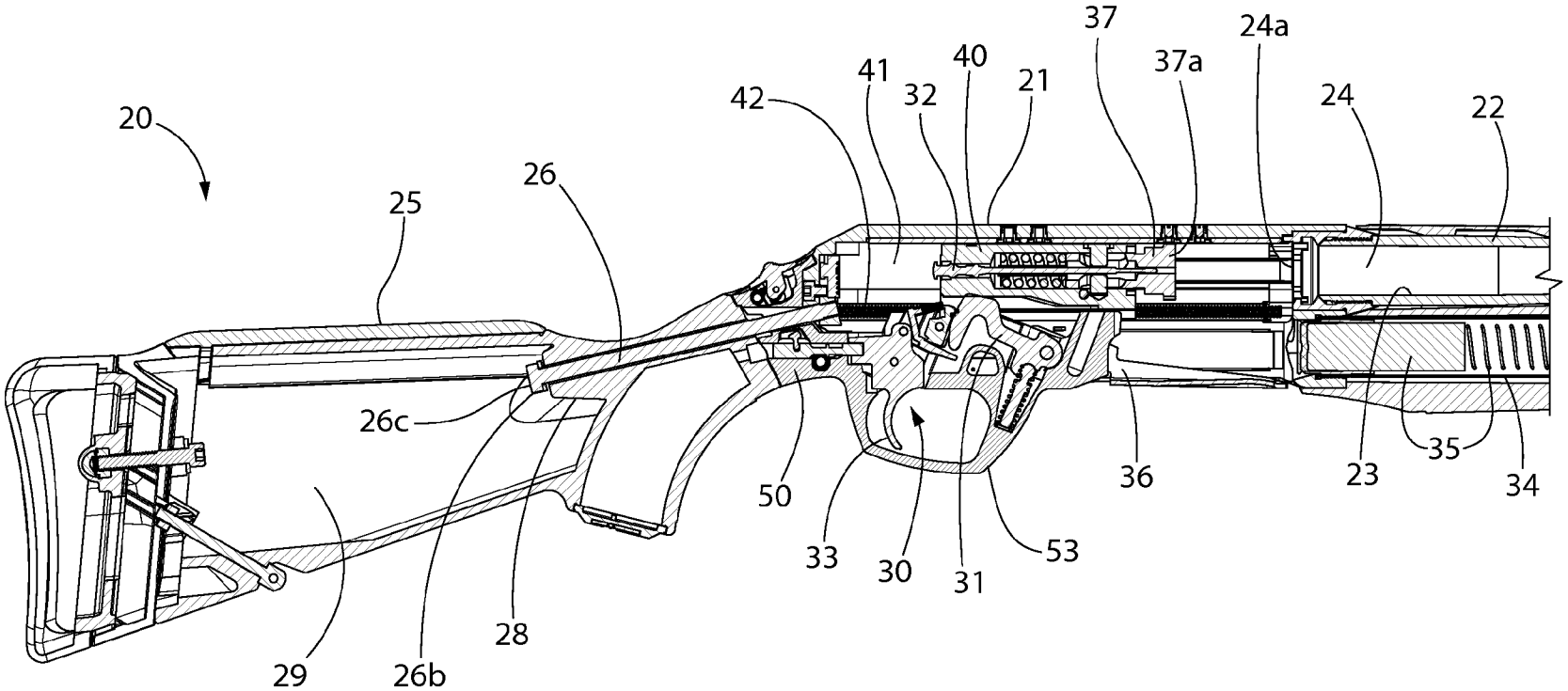
FIG. 1 is a partial longitudinal cross-sectional view of one exemplary embodiment of a firearm including a safety mechanism.

All drawings are schematic and not necessarily to scale. Parts given a reference numerical designation in one figure may be considered to be the same parts where they appear in other figures without a numerical designation for brevity unless specifically labeled with a different part number and/or described herein.

DETAILED DESCRIPTION

The features and benefits of the invention are illustrated and described herein by reference to exemplary embodiments. This description of exemplary embodiments is intended to be read in connection with the accompanying drawings, which are to be considered part of the entire written description. Accordingly, the disclosure expressly should not be limited to such exemplary embodiments illustrating some possible non-limiting combination of features that may exist alone or in other combinations of features.

In the description of embodiments disclosed herein, any reference to direction or orientation is merely intended for convenience of description and is not intended in any way to limit the scope of the present invention. Relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise.

The term "action" is used herein in its conventional sense in the firearm art as meaning the mechanism that loads and ejects shells into/from the firearm and opens and closes the breech (i.e. the area in the receiver between an openable/closeable breech face on the front of the bolt and the rear face of the barrel chamber).

Figure 2:
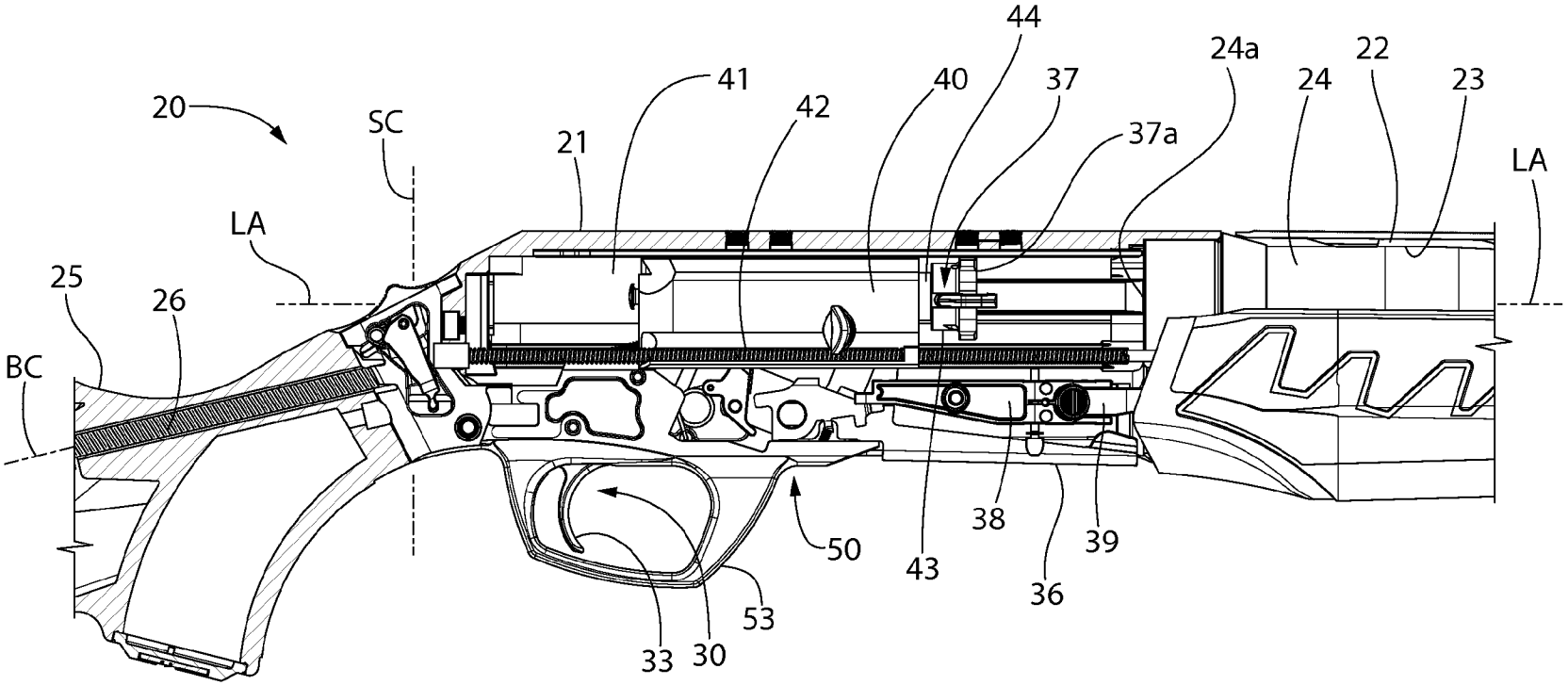
FIG. 2 is a more detailed view of the receiver portion of the firearm.
Figure 3:
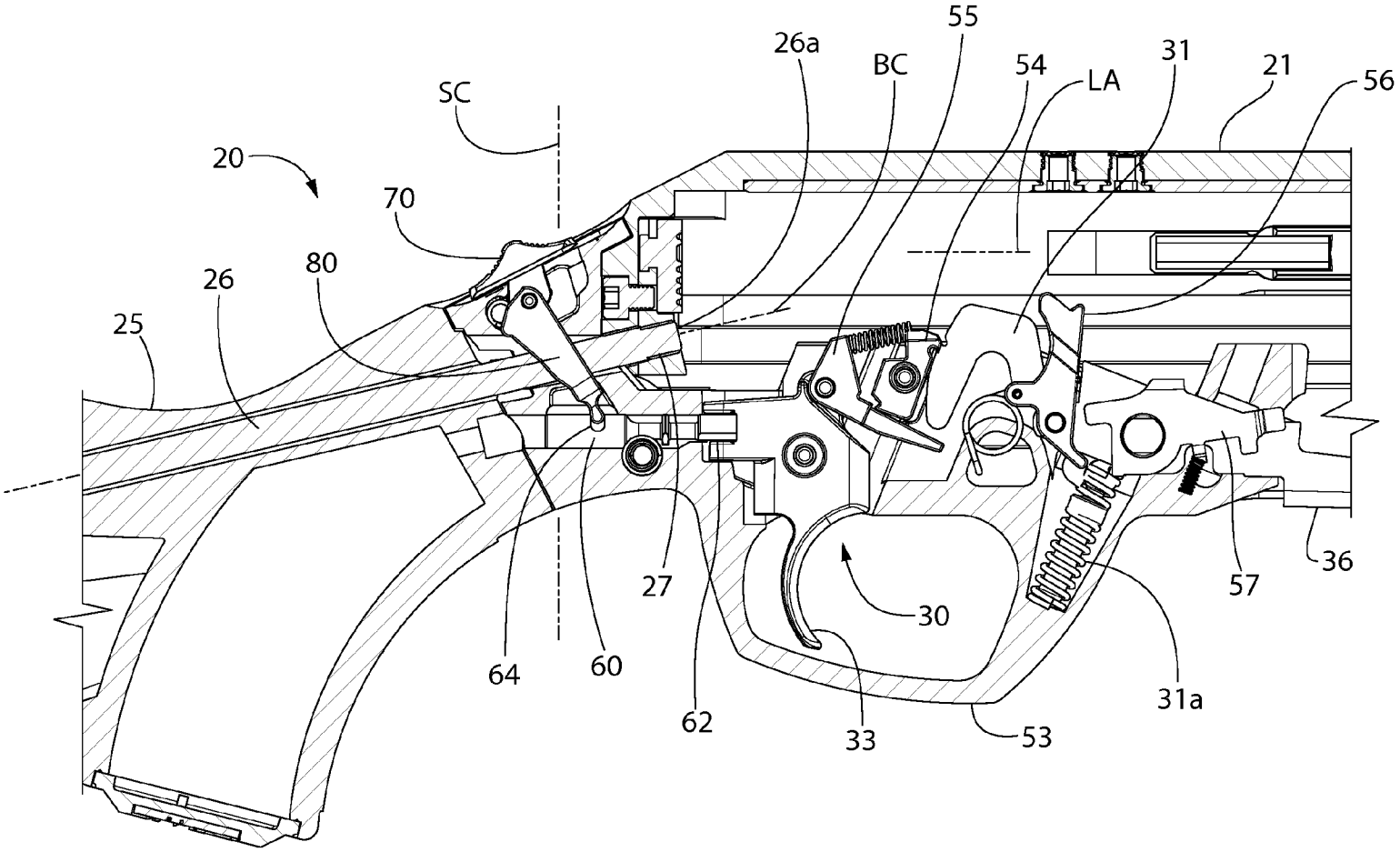
FIG. 3 is an enlarged view thereof showing the firing and safety mechanisms.

FIGS. 1-3 are longitudinal cross sectional views of the action portion of a firearm in the non-limiting form of shotgun 20 with safety mechanism according to one embodiment of the present disclosure. It will be appreciated that the safety mechanism may be used in other types of firearms, such as without limitation rifles. Accordingly, the invention is expressly not limited to use in shotguns alone.

The shotgun 20 includes a receiver 21, a barrel 22 fixedly coupled to the receiver and defining a longitudinal axis LA and corresponding axial direction coinciding with the centerline of the barrel bore 23, and a chamber 24 formed in the open rear end of the barrel configured to hold a cartridge or shell. A stock or buttstock 25 is attached to the rear end of the receiver. In one embodiment, the buttstock may be attached via a stock bolt 26 which extends axially forward from the buttstock and has a threaded front end 26*a* that threadably engages a rearwardly open threaded socket 27 disposed in the receiver. The threaded receiver socket 27 may be formed in a stock mounting plate which is inserted into the rear of the receiver in one configuration, or alternatively may be directly formed in the structure of the receiver itself in another configuration. The mounting plate if provided acts as a nut which is configured to engage but not rotate with respect to receiver to capture the threaded front end of the stock bolt and pull the stock and receiver together as the bolt is tightened.

A diametrically enlarged boss 28 may be formed inside the buttstock 25 at a front end of an open cavity 29 that engages the head 26*c* of the stock bolt 26 at its rear end 26*b*. When the stock bolt is rotated and tightened from inside the cavity 29 with an appropriate tool configured to engage the head 26*c* of the bolt, the buttstock 25 is drawn axially forward into tight engagement with the receiver 21 to secure the buttstock to the shotgun. For example, the bolt head may be hex-shaped and the tool may be a socket wrench in one embodiment. It will be appreciated that other suitable methods may be used to mount the buttstock to the receiver. The buttstock may be made of any type of material, including plastic, wood, composites, fiberglass or other as some non-limiting examples.

Referring to FIGS. 1-8, the fire control system includes a trigger mechanism 30 that is mechanically linked or coupled to a pivotably mounted hammer 31 which is movable between cocked and uncocked positions. Cycling the action (automatically or manually) cocks the hammer rearward into the ready-to-fire position. Pulling the trigger 33 uncocks and releases the hammer to strike an axially movable spring-loaded firing pin 32 (FIG. 1) that is driven forward to strike a chambered shell in a well-known manner.

The shotgun 20 may further include a tubular magazine 34 that holds a plurality of horizontally stacked shells. The magazine includes a shell follower and magazine spring assembly 35 as are well known to those skilled in the art which biases the shells toward an open rear of the magazine for loading into the shotgun by the action. In other embodiments, a conventional removable box style magazine may be provided in lieu of the tubular magazine. Such box magazines hold a spring-biased vertical stack of shells and attach to the underside of the receiver in the area between the trigger and barrel chamber to upload shells into an open breech. The invention is not limited by the type of magazine used.

With continuing reference to FIGS. 1-4 and the present embodiment of a shotgun being described, a pivotable carrier 36 is positioned behind the tubular magazine 34 that receives and uploads a shell from the magazine into the breech for chambering by the bolt 37. A carrier latch 38 and shell stop 39 may be provided that respectively control the uploading of shells to the breech and dispensing of shells from the magazine so that only a single shell is dispensed to the carrier at a time during the firing and reloading cycle.

The shotgun and its action further include a reciprocating bolt slide 40 (referred to herein as "slide" for short) and a bolt 37 operably carried by and coupled to the slide. The slide is movable axially in reciprocating rearward and forward motions to open and close the breech (action). The slide 40 is disposed in an open interior elongated compartment 41 within the receiver 21 and may travel along a track formed in the compartment to smoothly guide the slide. The bolt is carried by the front portion of the slide and projects axially forward from the slide. The bolt 37 has a forward facing surface that defines a breech face 37*a* which functions to form a closed or open breech in cooperation with the rear face 24*a* of the barrel chamber 24 in a well-known manner. FIG. 1 shows an open breech with the breech face 37*a* positioned rearward of the chamber. In a closed breech position (not shown), the breech face is positioned proximate to the rear face of the chamber to support the rear rim area of the shell for firing. The slide 40 and bolt 37 are coaxially aligned with the barrel 22 and longitudinal axis LA of the shotgun. The slide is axially movable between a forward closed breech position (shown) and rearward open breech position (not shown) spaced farther rearward from the chamber 24 (rear face 24*a*) to provide an axial gap for extracting and ejecting a fired or spent shell from the shotgun, and loading a new fresh shell into the chamber.

One or more recoil springs 42 may be provided which bias the slide 40 in a forward direction towards the barrel 22 and chamber 24. The spring(s) are compressed during recoil when the slide moves to the open breech position upon discharging the shotgun, and then expand to return the slide forward to the closed breech position automatically. In the present embodiment, two recoil springs 42 are provided whose compression and expansion are guided during movement of the slide by guide rods around which the springs are mounted. In one embodiment, the springs may be helical compression springs. Use of other types of springs is possible.

The bolt 37 has an axially elongated body including a bolt head 43 disposed outside the front end of the slide and a stem 44 projecting rearward from the bolt head. The stem is slideably disposed at least partially inside an axially elongated cylindrically shaped cavity in the slide 40 (see FIGS. 1 and 2). The bolt 37 is at axially movable with respect to the slide during cycling of the action in a well-known manner.

The bolt head 43 is generally cylindrical structure having a larger diameter than the diameter of the stem 44 or the slide cavity into which the stem projects from the bolt head. The breech face 37*a* is formed on the forward facing flat surface of the bolt head. The bolt head 43 includes an axial central passageway which penetrates the breech face and has a circular cross section. The passageway continues rearward through the stem forming a pocket for holding the firing pin 32. The firing pin is movable in an axial direction in relation to and through the bolt 37 and breech face 37*a* for striking and detonating a chambered shell when the breech face is closed (shown for example in FIG. 1). The pivotable hammer 31 moves between a cocked and uncocked position when released by the trigger mechanism to strike the rear of the firing pin 32 which in turn strikes the shell. Such operation is well-known in the art.

The action of the shotgun 20 may be a locked-breech design. Accordingly, in one non-limiting embodiment, the bolt head 43 may include a plurality of radially extending bolt locking lugs which are cooperatively configured to engage corresponding bolt locking lugs formed at the rear of the barrel chamber 24.

Figure 4:
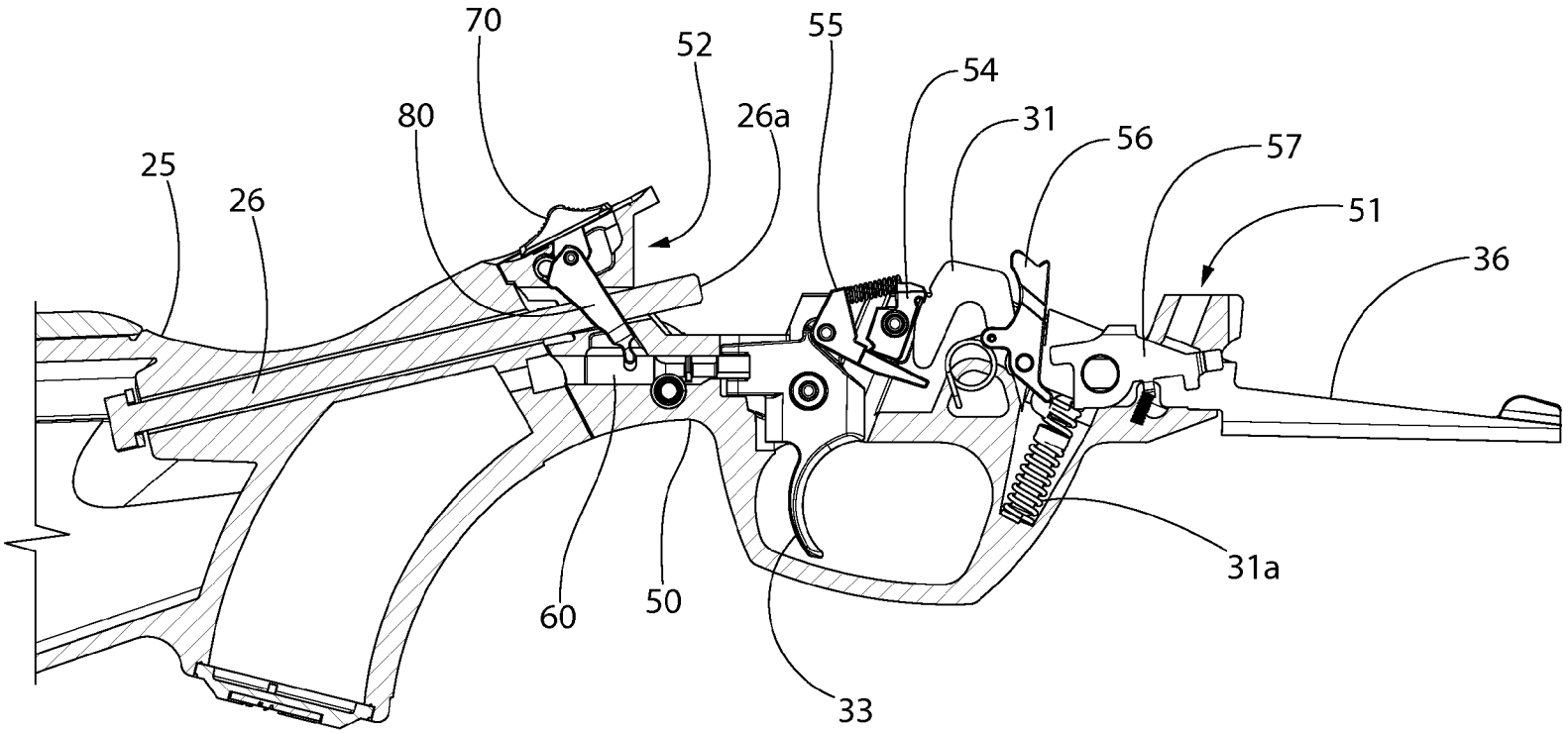
FIG. 4 is cross-sectional view showing the fire control module with firing and safety mechanisms and the front portion of a buttstock.

Referring to FIGS. 3-8, the shotgun further includes a fire control module 50 that houses and supports the fire control and safety mechanism components in operational relationship. The fire control module is a self-supporting and separate unit from the receiver that is configured for detachable mounting in the shotgun (see, e.g. FIG. 4 showing the fire control module alone removed from the shotgun). Accordingly, the fire control module 50 may be inserted into or removed from the shotgun (e.g. receiver 21) as a single component. The fire control unit may be mounted in an elongated longitudinally extending cavity defined by the receiver 21 below the axially extending slide compartment 41 which receives the reciprocating slide-bolt assembly.

The fire control module 50 generally includes trigger housing 51 configured for mounting the fire control components and an integrated rearwardly projecting safety housing 52 configured for mounting the safety mechanism components, as further described below. The trigger housing 51 may be axially elongated in a direction generally parallel to the longitudinal axis LA and extends horizontally. The safety housing 52 may be vertically elongated and protrudes both rearward and upward from the trigger housing 51 at the rear of the fire control module 50. In one embodiment, the safety housing may be slanted rearward and obliquely oriented at an angle between 0 and 90 degrees transversely to the longitudinal axis to optimize positioning of the safety operating button for the user, as further described herein.

The safety housing 52 may be either a separate part mechanically coupled to the trigger housing 51 by any suitable means, or alternatively may be formed integrally with the unitary trigger housing as illustrated herein being fabricated together with trigger housing as part of a single monolithic and unitary structure. In either type of construction, the trigger and safety housings collectively form the fire control module which may be detachably mounted to and removable from the shotgun receiver 21 as a complete unit including the fire control and safety mechanism components. It bears noting that the trigger and safety mechanisms are each fully supported and operational in the fire control module 50 removed from the receiver 21 to allow testing before assembly of the shotgun. The fire control module 50 may be fabricated by any suitable manufacturing process or combination of processes, such as casting, forging, milling, bending, stamping, welding, soldering, etc. The fire control module 50 may be made of any suitable metallic or non-metallic material appropriate for the service conditions encountered. In one embodiment, the fire control module may be made of polymer such as for example without limitation nylon. Suitable metals that could be used include aluminum, steel, titanium, and others.

In one embodiment best shown in FIG. 3, the fire control module 50 may include the following fire control system components: trigger mechanism 30 including pivotable trigger 33 operably coupled to the hammer 31, rotatable sear 54 mechanically linked to the trigger and configured to hold and release the hammer in the cocked/decocked positions, rotatable sear blocker 55 operably linking the trigger to the sear, carrier 36, carrier pawl 56, and carrier pawl disconnect 57 coupled to the carrier and operable to move the carrier between the raised shell loading position and lowered shell receiving positions, and carrier latch/shell stop assembly 38/39 (see FIG. 2). A hammer spring 31*a* biases the hammer 31 into the decocked position for striking the firing pin to discharge the shotgun. In one embodiment, the sear 54 may include a hook which engages a notch formed in the hammer for holding the hammer in the cocked position. Sear 54 is spring-biased into engagement with hammer 31. In certain embodiments, the trigger housing 51 may include and define a trigger guard 53 which may be a separate part attached to the housing 51 or formed as an integral unitary structural part of the housing 51.

Referring to FIGS. 1-8, the safety mechanism mounted to and supported by the safety housing 52 of the fire control module 50 may include a blocking me such as linearly movable safety bolt or pin 60, an actuator such as slidable operating button 70, and a mechanical linkage or link such as a lever arm 80 that mechanically couples the button to the safety pin. Selectively sliding the operating button 70 forward and rearward alternatingly moves the safety mechanism between the deactivated ready-to-fire and activated safe positions, as shown in FIGS. 7 and 9 and FIGS. 8 and 10, respectively.

The safety mechanism will now be further described with particular reference to FIGS. 5-11 initially.

Figure 17:
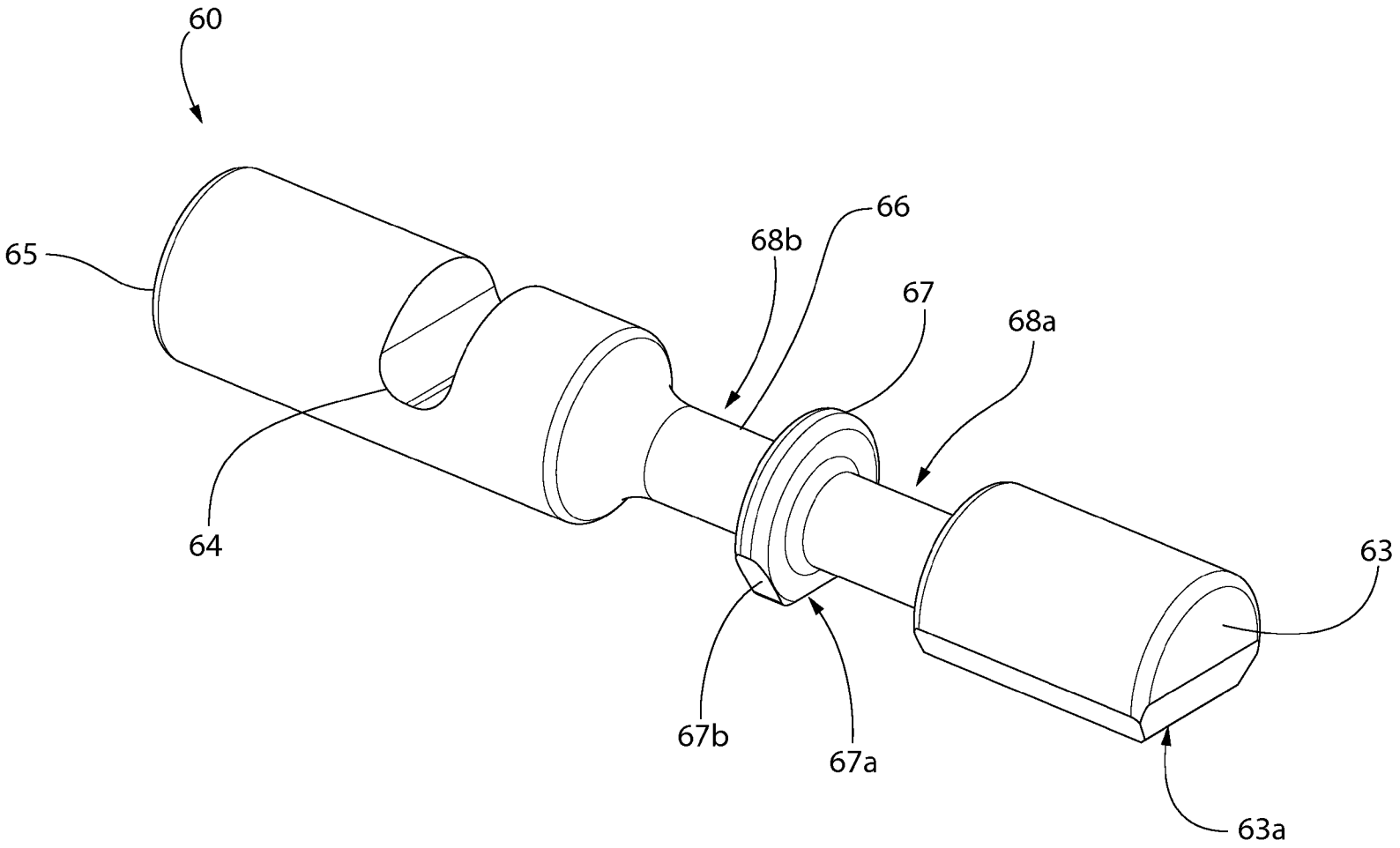
FIG. 17 is a top perspective view of the safety pin which selectively engages the firing mechanism.

The safety pin 60 may be cylindrically shaped in a certain embodiment having a circular transverse cross section (see also FIG. 17). However, other suitable pin and cross section shapes may be used including polygonal cross sectional shapes such as square or rectangular. The pin 60 is slideably received and movable axially/linearly within a longitudinally extending bore 61 formed in the safety housing 52. The longitudinal bore 61 may also have a cylindrical shape to complement the shape of the safety pin. The bore has an open forward end that communicates with a rearwardly open socket 62 in the trigger 33. The forward end 63 of the safety pin 60 is configured and dimensioned to fit and slide into the socket 62 for arresting movement of the trigger and firing mechanism when the safety mechanism is activated.

The operating button 70 is slideably mounted on a top operating surface 71 of the safety housing 52. The operating surface may be disposed at an angle A1 to the longitudinal axis LA (see FIG. 8) to better ergonomically position the button for operation by a user's thumb or finger. In one embodiment, the operating button 70 may be partially recessed into the operating surface 71 being positioned in an axially elongated depression sized to allow full movement of the button forward and rearward between the deactivated and activated positions. The outward facing exposed grasping portion 73 of the operating button 70 may be configured and textured (e.g. ridges, knurling, etc.) to facilitate a non-slip engagement with a user's thumb or finger.

Figure 16:
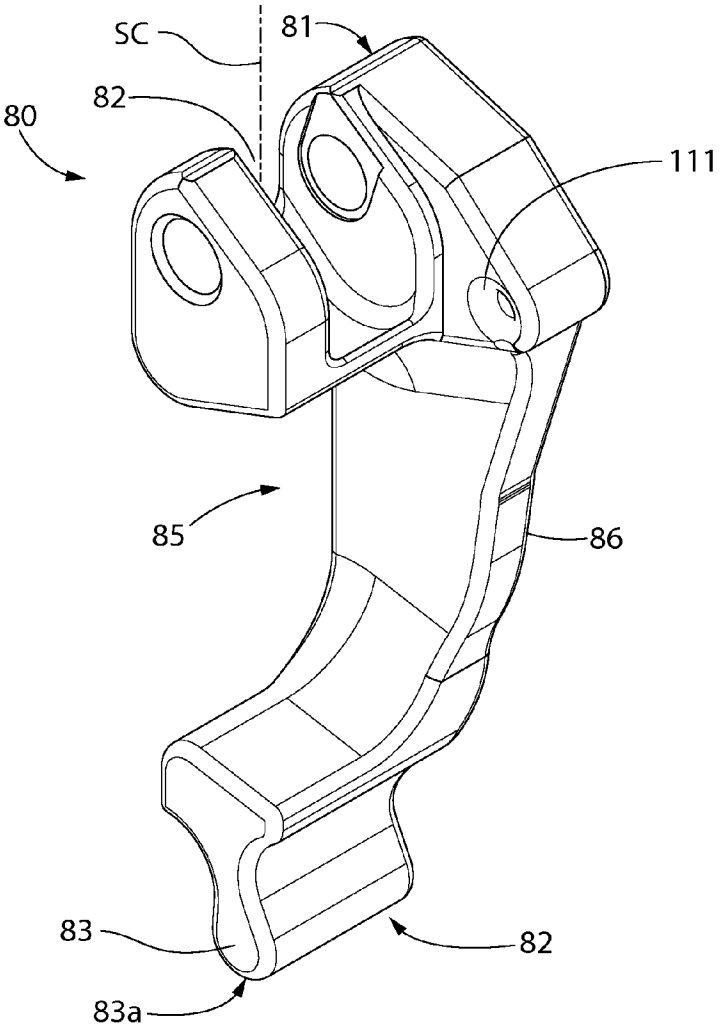
FIGS. 15 and 16 are side perspective views of the safety coupling linkage.
Figure 15:
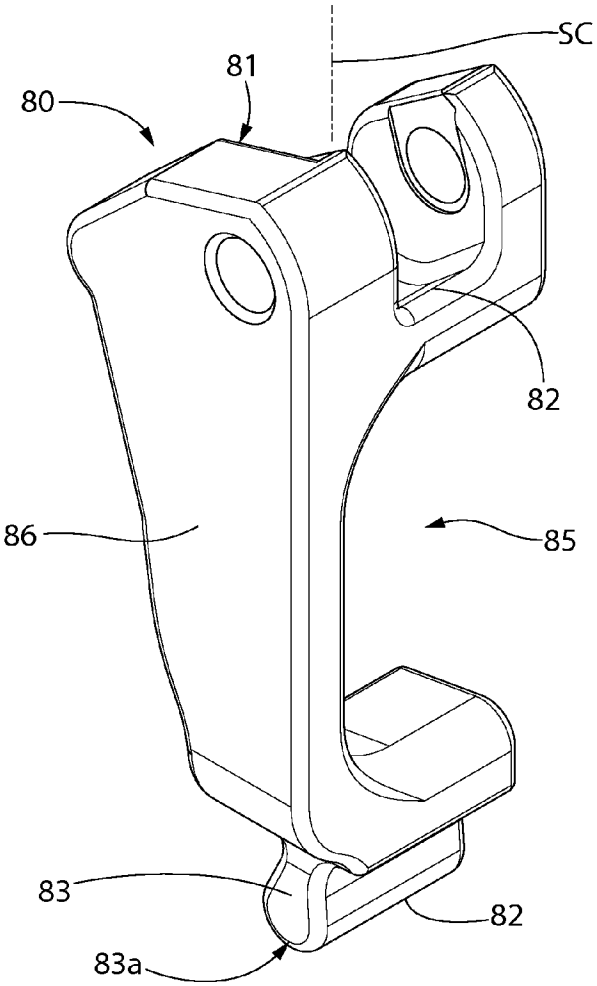

With additional reference to FIGS. 11-14, the safety operating button further includes a lower extension portion 72 projecting downward from the upper grasping portion 73 which is positioned inside the upper part of the safety housing 52. The lower extension portion 72 extends through an axially elongated slot formed in the operating surface 71 of the safety housing. The lower extension portion of the operating button 70 is pivotably coupled to the upper end 81 of the safety lever arm 80 via a transversely mounted pivot pin 74. This enables the lever arm to be toggled in axially forward and rearward directions by moving the operating button 70 in the opposite axially rearward and forward directions, respectively. The upper end 81 of safety lever arm 80 may have a bifurcated structure as best seen in FIGS. 15-16, thereby forming an axially oriented channel 82 for receiving the lower extension portion 72 of the operating button 70.

The safety lever arm 80 further includes a lower end 82 configured to engage an upwardly open slot 64 transversely oriented and formed in a top surface of the safety pin 60 (reference FIGS. 7-12 and 15-17). Slot 64 is disposed between the forward and rearward ends 63, 65 of the pin. The upper end 81 of lever arm 80 may be wider (as measured in the longitudinal or axial direction) than the lower end 82 giving the lever arm a narrowing configuration in moving from the upper to lower end. In one embodiment, the lower end 82 includes a downwardly projecting camming protrusion 83 configured and dimensioned to engage the slot 64 for moving the safety pin 60 between its forward and rearward safe and ready-to-fire positions engaging and disengaging the trigger 33, respectively. The camming protrusion 83 in one embodiment may have a generally lobed or tear-drop shape and defines a convex arcuately curved camming surface 83*a* which engages mating follower surfaces defined by the slot 64 in the safety pin 60. This rounded terminal end of the camming protrusion 83 formed by the arcuate camming surface 83*a* facilitates smooth engagement with and operation of the safety pin via slot 64. In one embodiment, the follower surfaces may be substantially flat and defined by opposed front and rear vertical walls 84*a*, 84*b* positioned within the slot 64 on both the front and rear sides 86*a*, 86*b* of the camming protrusion 83 (see, e.g. FIGS. 9 and 10). The front/rear vertical walls 84*a*, 84*b* alternatingly engage the camming protrusion 83 when the safety link 80 is toggled via the operating button 70 to slide the safety pin 60 into and out of engagement with the trigger 33. In certain embodiments, the camming protrusion 83 may be narrower in axial width (measuring along the longitudinal axis) than the adjoining lower end of the lever arm 80 to engage the slot. The lever arm 80 preferably is vertically elongated in the embodiment shown to maximize the mechanical advantage (i.e. leverage) for smoothly moving the safety pin 60 axially into and out of engagement with the trigger (i.e. socket 62) shown in FIGS. 7 and 8.

Referring to FIG. 17, the safety pin 60 in certain embodiments may have a flat bottom surface 63*a* formed adjacent the forward end 63 which engages a mating flat surface formed inside the socket 62 of the trigger 33. This forms a flat-to-flat interface for positively arresting movement of the trigger. In other embodiments, however, the forward end of the pin and socket may each be completely circular or round.

According to another aspect of the invention, a first detent mechanism may be provided to help retain the safety pin 60 in the forward safe position engaged with the trigger 33 or the rearward ready-to-fire position disengaged from the trigger for discharging the shotgun 20 via a trigger pull. In one embodiment referring to FIGS. 11, 12, and 17, the detent mechanism may comprise a detent flange 67 projecting radially outwards from a reduced diameter central portion 66 formed on the safety pin 60. The flange 67 and central portion 66 are disposed between the ends 63, 65 of the pin. The flange 67 engages a transversely mounted compression spring 100 disposed and retained in a transverse cross bore 101 formed in the safety housing 52 of the fire control module 50. Transverse bore 101 intersects the longitudinal bore 61 also formed in the safety housing 52 in which the pin 60 slides. In one implementation, the spring 100 may have coils configured to form an hourglass configuration with the opposing end portions 103 of the spring having a larger diameter than a reduced diameter middle portion 104. The reduced diameter middle portion 104 allows the middle of the spring to deflect and deform within the confines of cross bore 101 when the detent flange 67 passes forward or rearward over the spring before the spring returns to its original undeformed configuration. Front and rear recesses 68*a*, 68*b* formed on either side of the flange 67 by the reduced diameter central portion 66 retain the spring 100 on either side of the flange corresponding to the safe and ready-to-fire positions of the safety pin 60. In operation, when the pin 60 is moved forward or rearward via operation of the operating button 70, the flange 67 passes over and resiliently deforms the spring thereby creating an unstable condition in which the flange will favor being positioned in and gravitate towards either the front or rear recesses 68*a*, 68*b* creating a positive two-position detent action. In some embodiments, the detent flange 67 may include a bottom chamfer forming a flat bottom surface 67*a* and two adjoining angled side chamfered surfaces 67*b* on either side to facilitate smooth movement of the flange over the spring 100.

Figure 10:
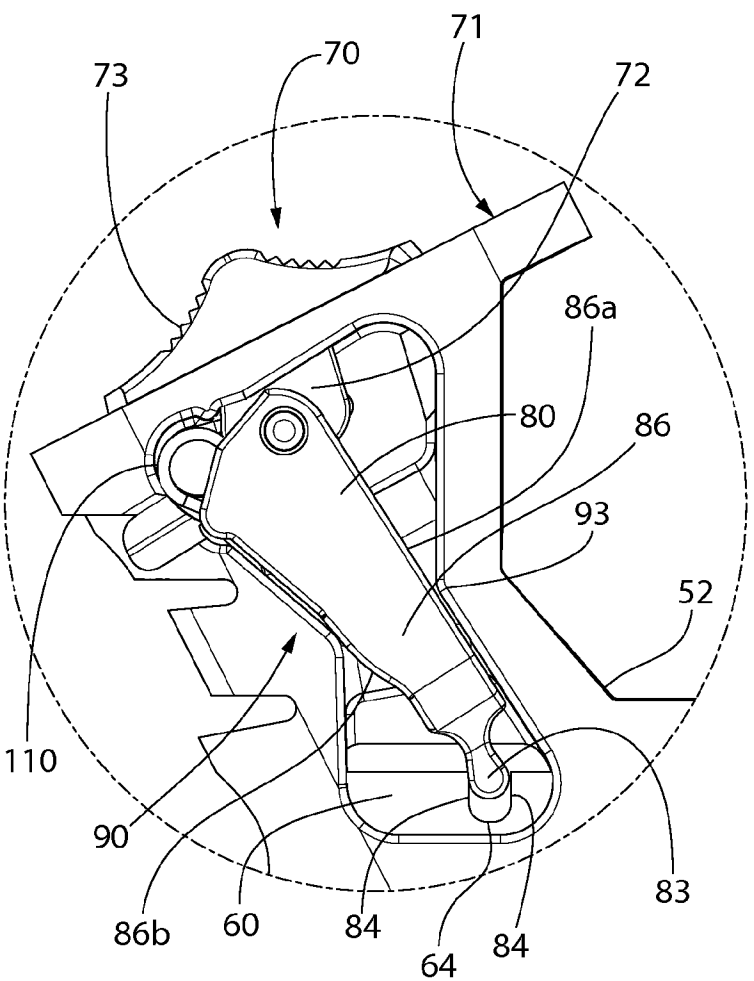
FIG. 10 is a detailed side view of the operating mechanism of the safety with the safety in the safe position.
Figure 9:
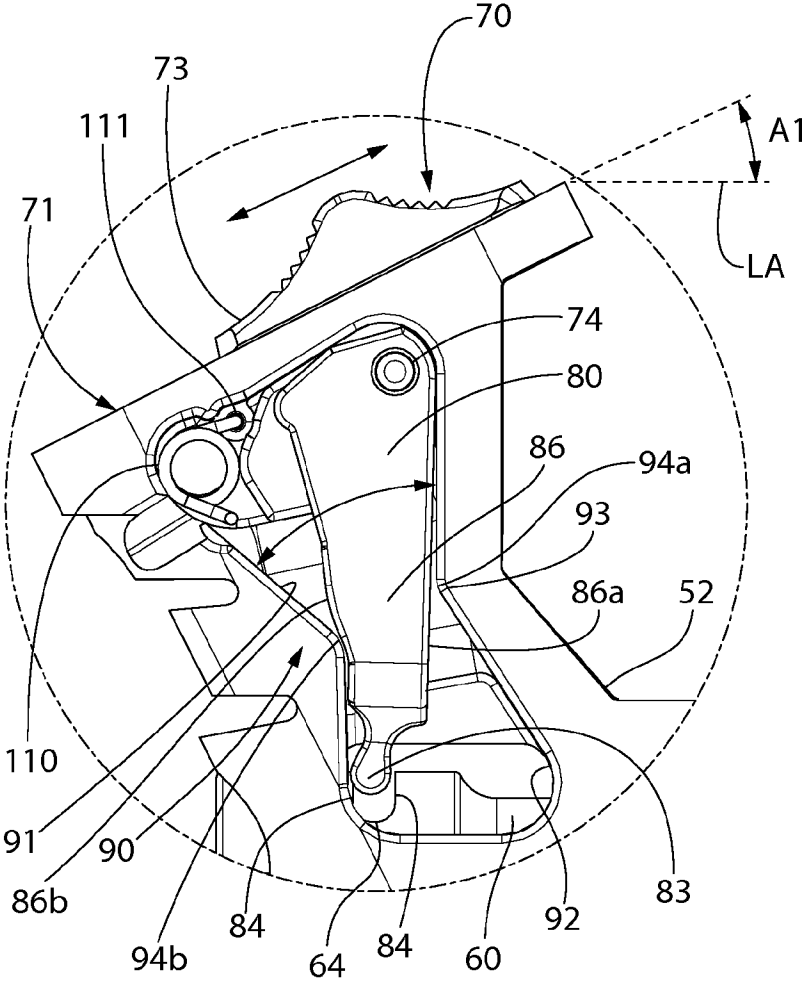
FIG. 9 is a detailed side view of operating mechanism of the safety with the safety in the ready-to-fire position.
Figure 11:
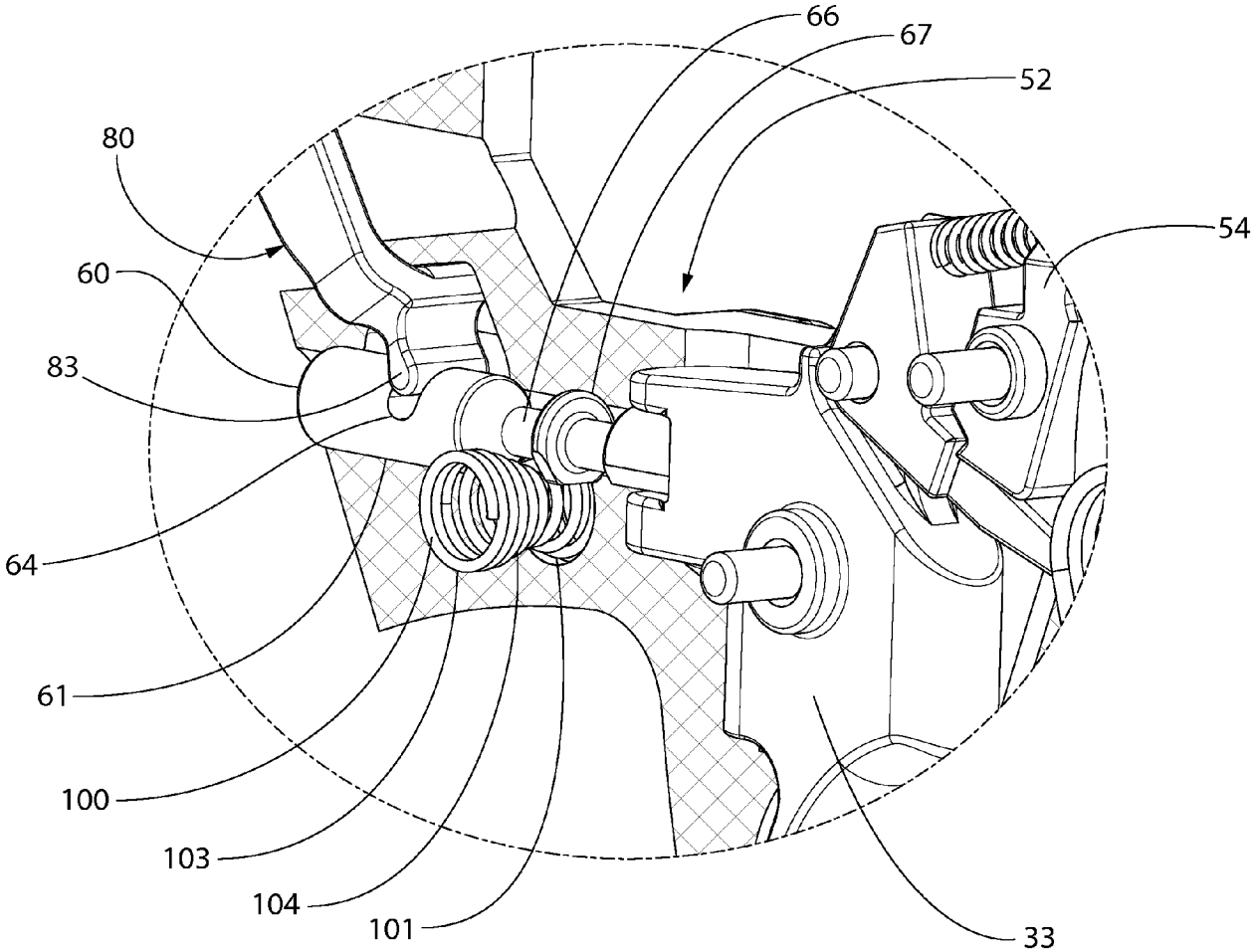
FIG. 11 is an enlarged partial cross-sectional side perspective view thereof showing a detent assembly for maintaining the safety in the ready-to-fire or safe positions.
Figure 12:
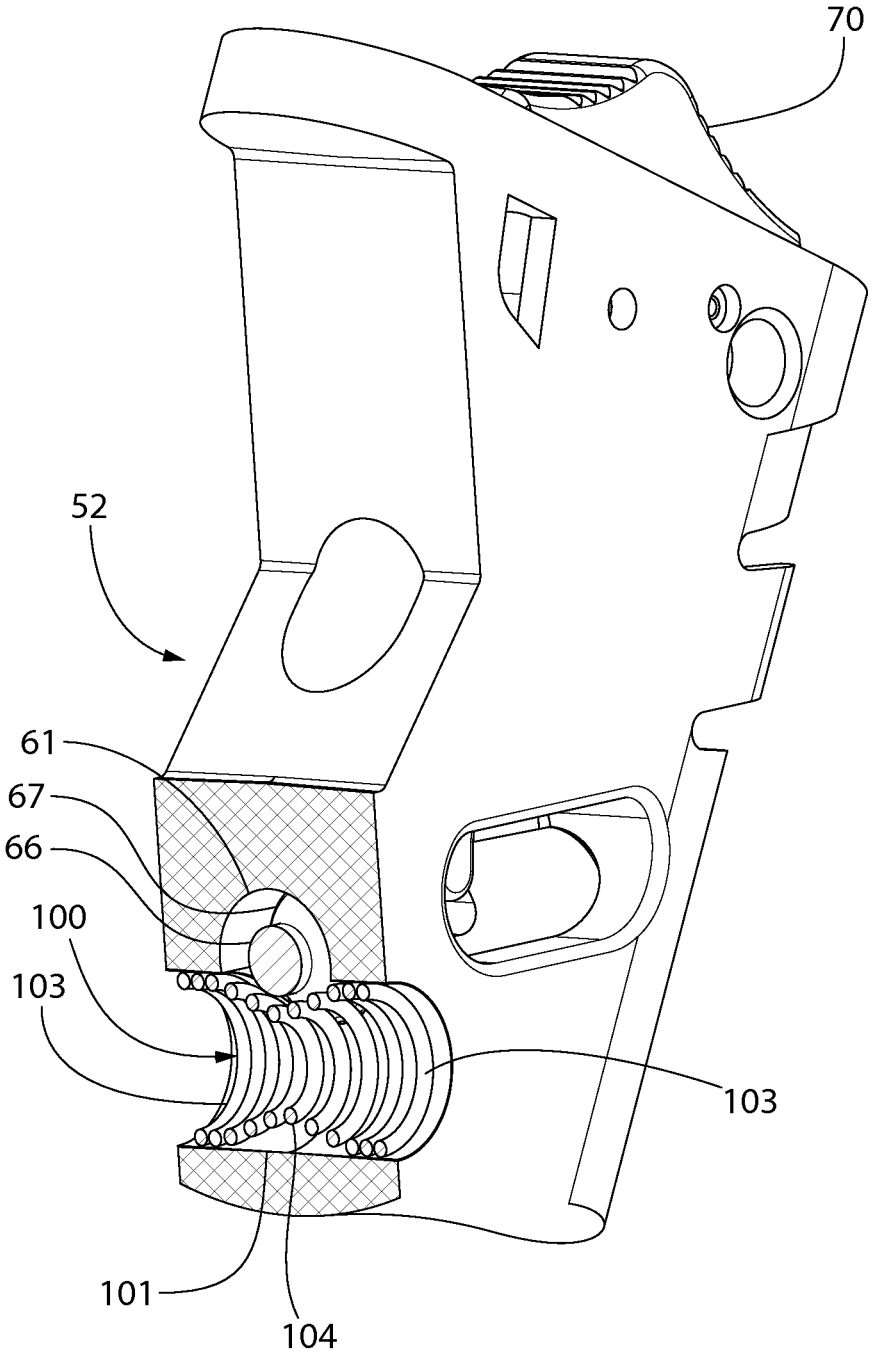
FIG. 12 is an enlarged partial cross-sectional front perspective view thereof showing the detent assembly.
Figure 13:
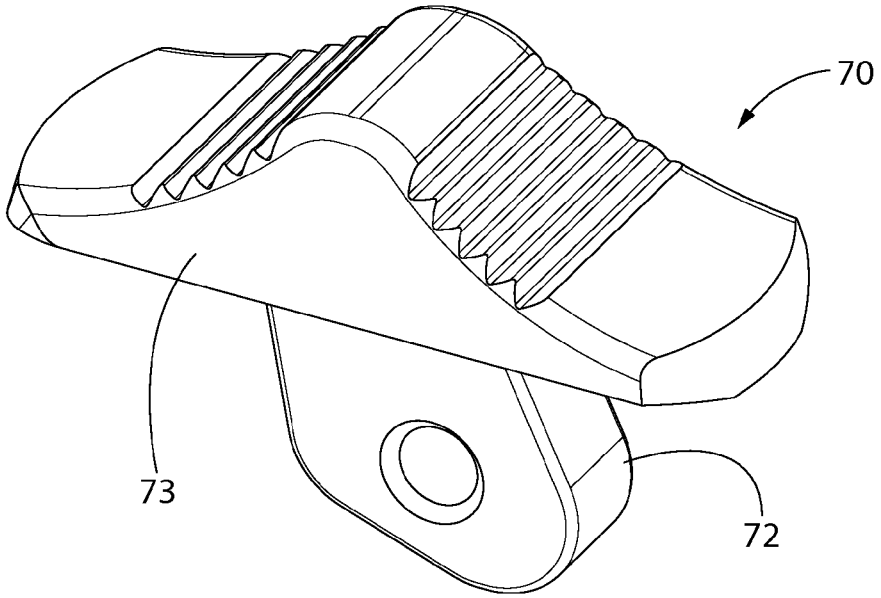
FIGS. 13 and 14 are top and bottom perspective views of the safety operating button.
Figure 14:
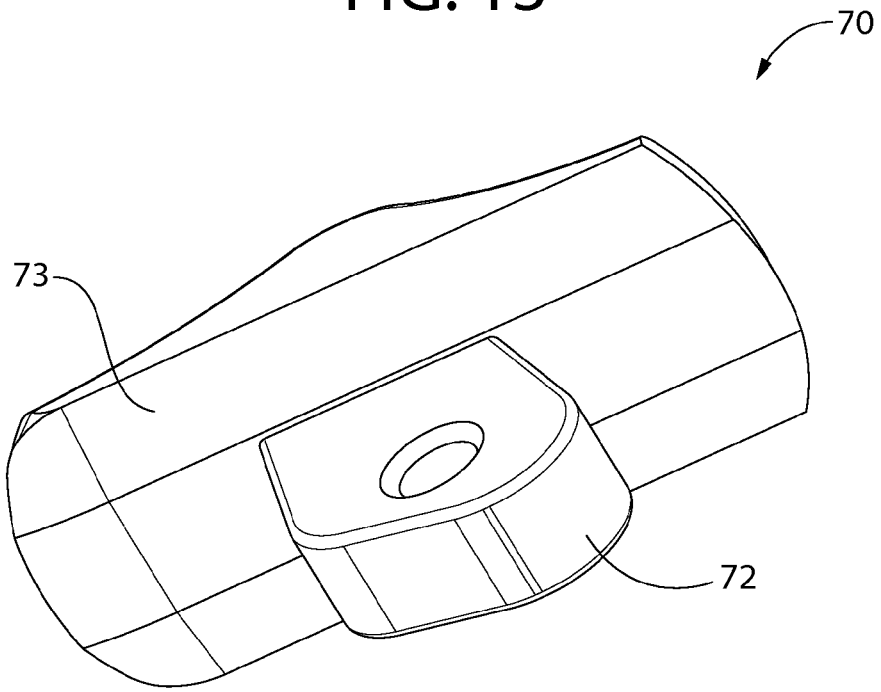

In one embodiment with reference to FIGS. 9-10, the lever arm 80 may be movably disposed in a vertically elongated cavity 90 formed in the safety housing 52. The cavity 90 may extend laterally through one or both sides of the safety housing in certain embodiments. The cavity may have any suitable shape. In one non-limiting configuration, the cavity 90 may have an hourglass shape with an upper chamber 91, a lower chamber 92, and a reduced width narrowed throat 93 disposed therebetween. The throat 93 defines angled front and rear bearing surfaces 94*a*, 94*b* in the safety housing 52 positioned to engage the midsection 86 of the lever arm 80. Each front and rear bearing surface may therefore include an apex which is arranged to correspondingly engage front and rear surfaces on the midsection 86 of the lever arm. The front and rear bearing surfaces 94*a*, 94*b* define a pair of opposing fulcrums which operably impart a pivotable and toggle-like action to the lever arm 80 when moved via the operating button 70, as further described herein. The front and rear fulcrum of the throat 93 of the cavity 90 provide a pin-less pivot axis for the lever arm 80.

Figure 7:
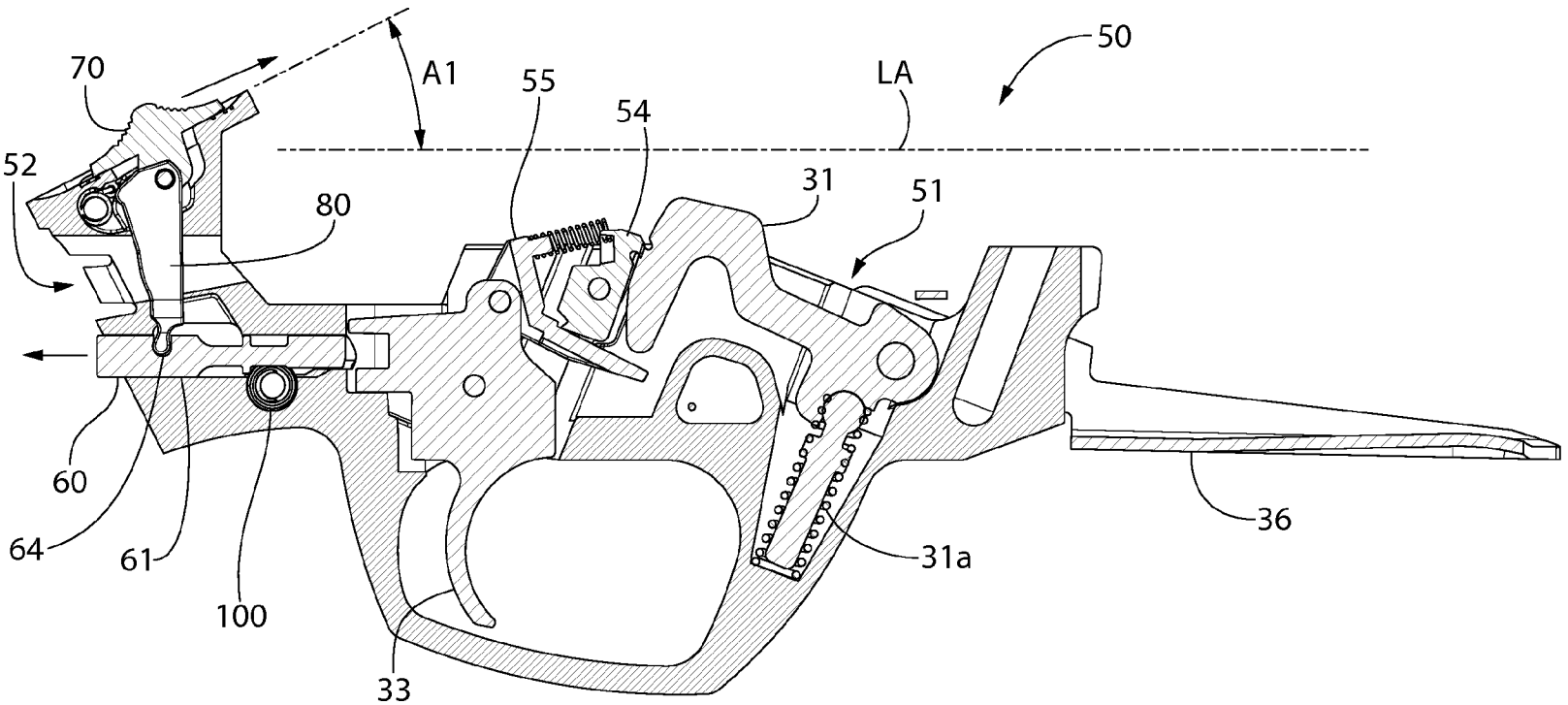
FIG. 7 is a cross-sectional view thereof showing the safety mechanism in a ready-to-fire position disengaged from the firing mechanism to allow discharging the firearm.

In operation, pivoting movement of the safety lever arm 80 via the operating button 70 imparts linear axial movement to the safety pin 60 into and out of engagement with the trigger 33 through interaction between the bearing surfaces 94*a*, 94*b* of the cavity 90 and the lever arm. FIGS. 7 and 9 show the safety mechanism in the deactivated and "ready to fire" position in which the trigger is able to pivot when pulled to release a cocked hammer 31 and fire the shotgun 20. The safety pin 60 is rearward and disengaged from the trigger allowing it to move (i.e. operable). The operating button 70 and upper end 81 of the lever arm 80 are each in a forward-most position. The midsection 86 of the lever arm is engaged with the angled rear bearing surface 94*b* of the cavity.

Figure 8:
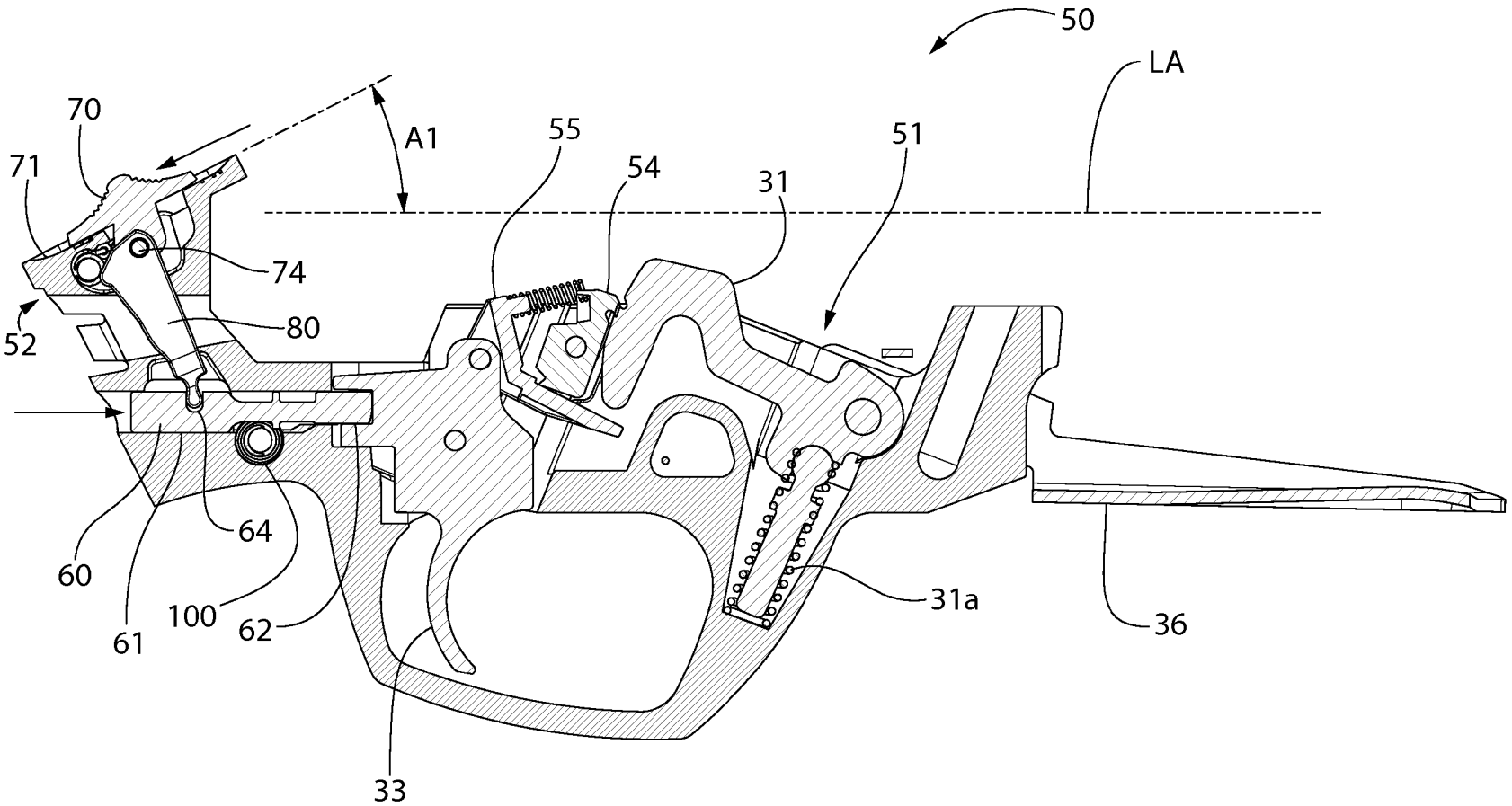
FIG. 8 is a cross-sectional view thereof showing the safety mechanism in the safe position engaged with the firing mechanism to prevent discharging the firearm.

FIGS. 8 and 10 show the safety mechanism in the activated and "safe" position in which the trigger 33 is blocked from movement when pulled (i.e. inoperable) and prevented from releasing a cocked hammer 31. The shotgun 20 therefore cannot be fired. To reach this position, the operating button 70 is slid rearward which pivots the upper end 81 of the lever arm 80 rearward about its pivot pin 74 (i.e. pivot axis) due to mutual engagement between the rear fulcrum defined by the angled rear bearing surface 94*b* of the cavity 90 and the midsection 86 of the lever arm. This interaction between the midsection and rear fulcrum causes the lower end 82 of the lever arm 80 (and camming protrusion 83) to rotate forward concomitantly pushing and sliding the safety pin 60 axially forward into engagement with the trigger (compare FIGS. 7 and 9), thereby locking the trigger in position against movement.

In now returning the safety mechanism to the deactivated (ready-to-fire) position shown in FIGS. 7 and 9, it is primarily the engagement between the front fulcrum defined by the front bearing surface 94*a* of the cavity 90 and lever arm 80 that now causes the desired pivotable movement of the lever arm. To reach this position, the operating button 70 is slid forward which pivots and toggles the upper end 81 of the lever arm rearward about its pivot pin 74 (i.e. pivot axis) due to mutual engagement between the front fulcrum and the midsection 86 of the lever arm 80. This interaction between the midsection and front fulcrum causes the lower end 82 of the lever arm 80 (and camming protrusion 83) to rotate rearward concomitantly pulling and sliding the safety pin 60 axially forward to withdraw and disengage the pin from the trigger (compare FIGS. 8 and 10), thereby freeing the trigger 33 to move and fire the shotgun.

It will be appreciated that in some arrangements of the cavity 90 and lever arm 80, both the front and rear fulcrums may interact with the lever arm to contribute to causing the foregoing rearward and forward motions described. It should be noted that without the front and rear fulcrum, sliding the operating button rearward would not cause the desired lever arm movements in the foregoing manner described via a toggle-like action to alternatingly lock or unlock the trigger. It further bears noting that the toggle action is achieved without a cross pivot pin in the midsection 86 of the lever arm 80 resulting in a mechanically simple and reliable operation.

One purpose of the shape of the lever arm 80 (safety link) is to allow the pivot pin 74, which connects the safety operating button 70 to the lever arm as shown in FIGS. 9 and 10, to move linearly in a straight line to engage the trigger 33. This requires the other two contact areas on the lever arm 80 to both rotate and translate as the lever arm is actuated. In order to keep the backlash in the system to a minimum, it is desired that these contact areas maintain a minimum amount of clearance. In the area of the lever arm 80 that engages the safety pin 60 (i.e. lower end 82 which defines the downwardly projecting camming protrusion 83), it can be seen how the clearance gap is maintained because the shape resembles a pin sliding in a slot. At the midsection 86 of the lever arm 80, surfaces of the lever arm are configured to maintain a generally constant gap between the two front/rear fulcrum points (i.e. front and rear bearing surfaces 94*a*, 94*b*) in the safety housing 52 and the lever arm. In an alternative configuration, another way to accomplish the same thing is to put two diametrically aligned convex surfaces on the midsection 86 of the link instead and put two opposing parallel surfaces on the housing. Either configuration is satisfactory and achieves the desired movement and functionality.

In one embodiment, the safety mechanism may be held in the desired activated (safe) or deactivated (ready-to-fire) positions with a second detent mechanism. In one possible design shown in FIGS. 9 and 10, a torsion spring 110 is used. The legs of the torsion spring are mounted one in the housing and one engages with a hole 111 formed in the lever arm 80 (see also FIG. 16). As the lever arm 80 is actuated via sliding the operating button 70, the lever arm compresses the torsion spring 110. The midpoint of the travel of the top end 81 of the safety link in the upper end of the cavity 90 is the point of maximum compression of the spring (particularly if the cavity includes a convex surface). This causes an unstable condition at the midpoint with the spring 110 trying to move the safety button either front or rear to get to a lower compression state or point associated with portions of the cavity which are vertically deeper than at the midpoint. Accordingly, this effectively maintains the safety link and operating button in either the forward or rearward positions associated with the deactivated and activated positions of the safety mechanism respectively.

Figure 5:
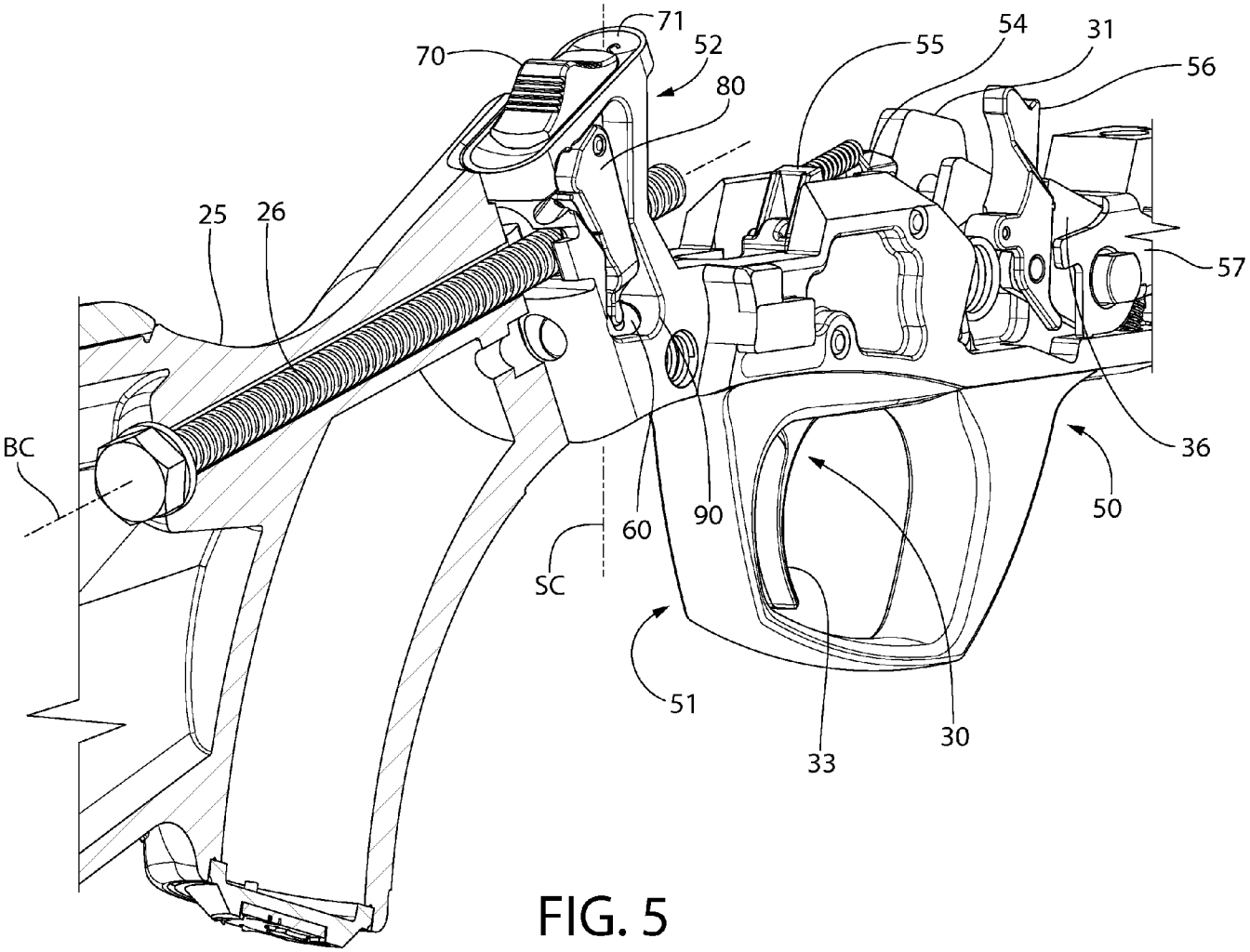
FIG. 5 is a rear perspective view thereof.
Figure 6:
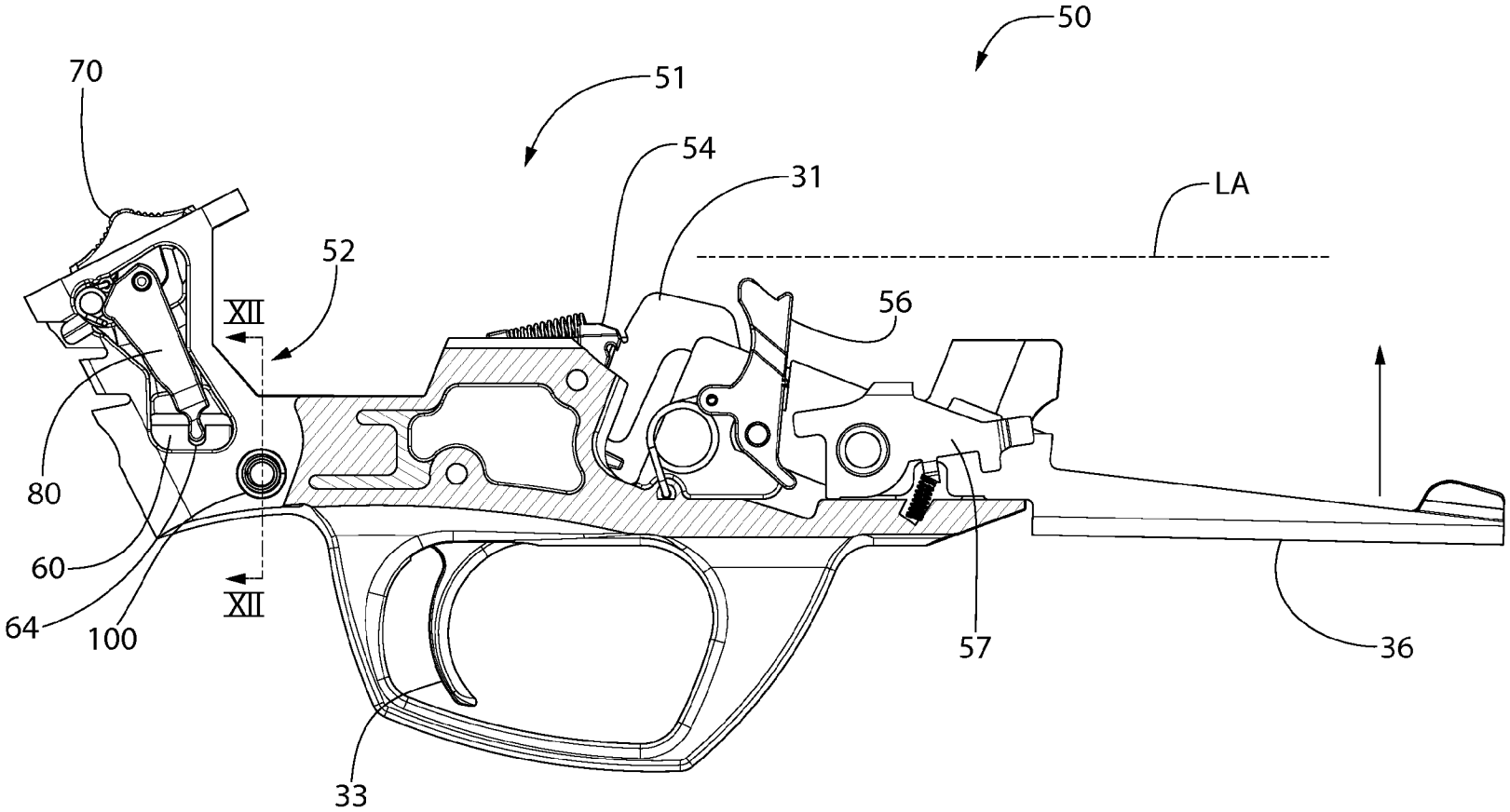
FIG. 6 is a side view of the fire control module.

Whereas some known designs must mount the operating button of the safety mechanism on the side of receiver in order to accommodate a stock bolt, the safety lever arm 80 of the present safety mechanism advantageously is specially configured and arranged to permit mounting the operating button 70 on the top rear of the fire control module 50 in an ergonomically desirable location (see, e.g. FIG. 2). In one embodiment as best illustrated in FIG. 5, the lever arm 80 may include an open bolt passageway 85 that extends axially completely through the lever arm (see, e.g. FIGS. 15-16). The stock bolt 26 passes through the lever arm, but does not interfere with the rearward/forward toggle-like movement of the lever arm. In one non-limiting embodiment, the lever arm may have generally a C-shaped configuration (shown) or alternatively L-shape wherein the bolt passageway 85 is formed by a laterally open slot formed by the vertical midsection 86 of the lever arm connecting the upper end 81 to lower end 82. Midsection 86 is laterally offset from the vertical safety centerline SC of the safety mechanism to avoid interference with stock bolt 26 during movement of the lever arm 80.

In other possible embodiments contemplated, the lever arm 80 may instead have a pair of generally parallel and laterally spaced apart midsections 86 disposed on either side of the open bolt passageway 85 which forms more of a completely circumscribed oblong hole in which the stock bolt 26 is completely captured in the passageway 85. Other suitable configurations of the lever arm and bolt passageway may be provided so long as the stock bolt may pass through the lever arm and safety mechanism to connect to the rear of the receiver.

While the foregoing description and drawings represent exemplary embodiments of the present disclosure, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes described herein may be made within the scope of the present disclosure. One skilled in the art will further appreciate that the embodiments may be used with many modifications of structure, arrangement, proportions, sizes, materials, and components and otherwise, used in the practice of the disclosure, which are particularly adapted to specific environments and operative requirements without departing from the principles described herein. The presently disclosed embodiments are therefore to be considered in all respects as illustrative and not restrictive. The appended claims should be construed broadly, to include other variants and embodiments of the disclosure, which may be made by those skilled in the art without departing from the scope and range of equivalents.

What is claimed is:

1. A firearm with safety mechanism comprising:

a receiver arranged along a longitudinal axis;

a trigger-actuated firing mechanism disposed in the receiver and comprising a movable trigger operable to discharge the firearm;

a safety mechanism configured to arrest the firing mechanism, the safety mechanism movable between a first position preventing movement of the trigger and a second position allowing movement of the trigger for discharging the firearm; and an elongated stock bolt attaching a buttstock to the receiver, the stock bolt passing through a portion of the safety mechanism to engage the receiver;

wherein a forward portion of the stock bolt extends through a longitudinal passageway formed in the safety mechanism;

wherein the passageway is formed in a lever arm that mechanically couples an operating button accessible to a user and a linearly movable blocking member selectively engageable with the firing mechanism via operation of the operating button;

wherein the blocking member slideably engages a rearwardly open socket formed in the trigger when the safety mechanism is in the first position.

2. The firearm according to claim 1, wherein the stock bolt has a front terminal end that extends forward beyond the operating button.

3. The firearm according to claim 1, wherein the firing mechanism and safety mechanism are mounted to a fire control module disposed in and removable from the receiver as a separate self-supported unit.

4. The firearm according to claim 1, wherein the stock bolt threadably engages a rear socket formed on the receiver.

5. The firearm according to claim 1, further comprising a barrel coupled to a front end of the receiver and a magazine below the barrel and configured for holding a plurality of ammunition shells.

6. The firearm according to claim 5, wherein the firing mechanism includes a carrier pivotably mounted to the firearm and operable to load shells dispensed by the magazine into the barrel.

7. A firearm with safety mechanism comprising:

a receiver arranged along a longitudinal axis;

a barrel coupled to a front end of the receiver;

a bolt axially movable forward and rearward in the receiver;

a fire control module attached to the receiver and removable therefrom as a separate self-supported unit, the fire control module comprising a trigger-actuated firing mechanism having a movable trigger and a safety mechanism;

the safety mechanism comprising a slideably movable operating button mechanically coupled to a blocking member, the blocking member linearly movable via operation of the operating button between a safe position engaged with the firing mechanism to prevent discharging the firearm and a ready-to-fire position disengaged from the firing mechanism to allow discharging the firearm; and an elongated stock bolt attaching a buttstock to a rear end of the receiver;

wherein the blocking member engages the trigger to prevent movement of the trigger when the blocking member is in the safe position;

wherein the blocking member engages a rearwardly open socket in the trigger when the blocking member is in the safe position.

8. A firearm with safety mechanism comprising:

a receiver arranged along a longitudinal axis;

a barrel coupled to a front end of the receiver;

a bolt axially movable forward and rearward in the receiver;

a fire control module attached to the receiver and removable therefrom as a separate self-supported unit, the fire control module comprising a trigger-actuated firing mechanism having a movable trigger and a safety mechanism;

the safety mechanism comprising a slideably movable operating button mechanically coupled to a blocking member, the blocking member linearly movable via operation of the operating button between a safe position engaged with the firing mechanism to prevent discharging the firearm and a ready-to-fire position disengaged from the firing mechanism to allow discharging the firearm; and an elongated stock bolt attaching a buttstock to a rear end of the receiver;

wherein blocking member is an elongated cylindrical pin.

9. The firearm according to claim 8, wherein the pin includes a reduced diameter central portion and a detent flange projecting radially outwards from the central portion, the detent flange being engageable with a transversely mounted compression spring which acts as a detent to retain the pin in either one of the safe or ready-to-fire positions.

10. The firearm according to claim 7, wherein the spring has an hourglass shape with middle portion having a diameter less than a diameter of end portions of the spring on opposite sides of the middle portion, the middle portion positioned to engage the detent flange.

11. A firearm with safety mechanism comprising:

a receiver arranged along a longitudinal axis;

a barrel coupled to a front end of the receiver;

a bolt axially movable forward and rearward in the receiver;

a fire control module attached to the receiver and removable therefrom as a separate self-supported unit, the fire control module comprising a trigger-actuated firing mechanism having a movable trigger and a safety mechanism;

the safety mechanism comprising a slideably movable operating button mechanically coupled to a blocking member, the blocking member linearly movable via operation of the operating button between a safe position engaged with the firing mechanism to prevent discharging the firearm and a ready-to-fire position disengaged from the firing mechanism to allow discharging the firearm;

an elongated stock bolt attaching a buttstock to a rear end of the receiver; and an elongated lever arm that mechanically couples the operating button to the blocking member, the stock bolt extending through an axially open passageway in the lever arm to engage the receiver.

12. The firearm according to claim 11, wherein the lever arm has a C-shaped configuration that defines the passageway.

13. The firearm according to claim 11, wherein a centerline of the stock bolt obliquely intersects a vertical centerline of the safety mechanism.

14. The firearm according to claim 11, wherein the lever arm includes a camming protrusion on a lower end that that engages an upwardly open slot in the blocking member for moving the blocking member between the safe and ready-to-fire positions.

15. The firearm according to claim 11, wherein the lever arm is movably disposed in an hour-glass shaped cavity having a reduced width throat section which engages opposite front and rear sides of the lever arm.

16. The firearm according to claim 11, further comprising a spring engaged with the lever arm and operable to bias the safety mechanism towards either of the safe or ready-to-fire positions.

17. The firearm according to claim 7, wherein sliding the operating button in a forward direction moves the blocking member rearward to the ready-to-fire position, and sliding the operating button in a rearward direction moves the blocking member forward to the safe position.

18. The firearm according to claim 7, wherein the ready-to-fire position is a rearward position of the blocking member and the safe position is a forward position of the blocking member.

19. The firearm according to claim 7, wherein the safety mechanism is mounted on a tang structure of the fire control module extending upwardly from a rear end of the fire control module.

20. A method for assembling a firearm with safety mechanism, the method comprising:

providing a trigger mechanism and a safety mechanism both pre-mounted in a self-supported fire control module, the safety mechanism including an operating button, an elongated blocking member movable to engage the trigger mechanism, and an elongated lever arm coupling the operating button to the blocking member;

inserting the fire control module into a receiver of a firearm;

positioning a buttstock against a rear end of the receiver;

inserting an elongated stock bolt through the buttstock and an opening in the lever arm; and securing a front end of the stock bolt to a rear end of the receiver.

21. The method according to claim 20, wherein the lever arm includes portions arranged above and below the stock bolt.

* * * * *